United States Patent [19]

Bisbee

[11] Patent Number: 4,799,877

[45] Date of Patent: Jan. 24, 1989

[54] CHILD-PROOF ADAPTOR FOR DISPOSABLE BUTANE CIGARETTE LIGHTER

[76] Inventor: Jerry L. Bisbee, 38153 Erie Rd., #20B, Willoughby, Ohio 44094

[21] Appl. No.: 206,088

[22] Filed: Jun. 13, 1988

[51] Int. Cl.[4] ..... F23D 11/36

[52] U.S. Cl. ..... 431/153; 431/144; 431/277; 222/153; 222/402.11; 251/89

[58] Field of Search ..... 431/153, 253, 277, 267, 431/144; 222/153, 402.11, 384; 251/89

[56] References Cited

U.S. PATENT DOCUMENTS

| | | | |
|---|---|---|---|
| 3,885,717 | 5/1975 | Ewald | 222/402.11 |
| 4,049,370 | 9/1977 | Neyret | 431/144 |
| 4,758,152 | 7/1988 | Kordecki | 431/153 |

*Primary Examiner*—Randall L. Green
*Attorney, Agent, or Firm*—Donald A. Bergquist

[57] ABSTRACT

This invention is a safety device for cigarette lighters fueled by butane or other compressed or liquified gas. The invention is a barrier adapted to selectively engage the thumb layer of the lighter to restrict the motion of the thumb layer, thereby to prevent the release of gas to the burner tip. The restricting member is supported by a band or sleeve that is adapted to at least partially surround and slidably engage the body of the lighter. A sliding motion of the band on the lighter engages or disengages the restricting member with the thumb lever; this motion may be selectively prevented or allowed by the selective engaging or disengaging of a spring-loaded member having a laterally extending projection adapted to fit into an opening in the lighter's structure.

4 Claims, 2 Drawing Sheets

CHILD-PROOF ADAPTOR FOR DISPOSABLE BUTANE CIGARETTE LIGHTER

INTRODUCTION

This invention deals with a safety device principally for disposable cigarette lighters fueled by butane or other compressed or liquified gas. Since their introduction, these cigarette lighters have become so commonplace as to be treated with a careless attitude by most adults and as an attractive toy by many children. In years past, it was commonplace for house fires to be described as being caused by children playing with matches. The 'match' of the present era is butane-fueled, flint-wheel ignited, and as ubiquitous as the matches of previous years.

Safety regulations ban the carrying of gas-fueled lighters on commercial aircraft, probably because of the potential hazard of an unexpected large size of the flame if the lighter is used by the passenger in the reduced-pressure atmosphere of the passenger cabin, yet those in the general public totally ignore this ban because of the casual attitude they take to commonplace objects, ignoring the inherent hazards.

An additional problem related to gas-fueled lighters is leakage of the gas while the lighter is stored in one's pocket or purse. These lighters are designed to release their gaseous fuel whenever the thumb lever is depressed, whether or not a spark is available for ignition. The thumb lever is normally unprotected, so gas may be released whenever other objects in the pocket or purse press against the lever, thereby creating an uneconomical loss of fuel and a potential hazard of fire or explosion.

The invention described in this patent addresses the hazard of gas-fueled cigarette lighters, the hazard being greatest when the lighter is in the hands of a child. The invention prevents the igniting of the lighter by preventing the release of the gaseous fuel by means of physically barring the movement of the thumb lever that operates the gas-releasing valve, yet the bar may be released by the proper manipulation of the release mechanism of the invention, which manipulation, involving two simultaneous motions, is difficult for a child to perform.

DISCUSSION OF PRIOR ART

No previous patents that are directed to the subject of this invention were uncovered in a patent search of the following Patent Office classifications: D27/36, D27/38, D27/42, 431/144, 431/146, 431/150, and 431/153.

The only patent that appears remotely relevant is Japanese Patent No. 0175922, issued in September of 1985. In this patent, gaseous fuel is released only after the thumb-engaging member is moved first laterally and then downwardly. The invention of the Japanese patent is a feature of the lighter as it is manufactured and could never be retrofit on pre-existing lighters.

U.S. Pat. No. 4,403,945 (Leitgib) teaches a gas-fueled lighter wherein the thumb lever is moved to a position wherein it cannot actuate the gas valve when a protective cover is closed. In addition to placing the thumb lever under the protective cover, the lever becomes disengaged from the gas valve. No such disengagement or movement of the thumb lever is required in the present invention, which can be a removable device adapted to fit onto an otherwise conventional lighter. The Leitgib invention is a feature of the lighter as it is manufactured and could never be retrofit on pre-existing lighters.

Pre-sale security devices for disposable lighters have been patented. In these devices, a shield or obstruction to the operation of the thumb lever and hence the fuel valve is removed after the lighter is purchased and before the lighter can be used. In each case the obstruction or shield is held in place by an attachment means that is destroyed when the obstruction or shield is removed. Such devices are taught in U.S. Pat. Nos. 4,049,370 (Neyret) and 3,938,943 (Malamoud).

SUMMARY OF THE INVENTION

It is an object of this invention to provide, for a gas-fueled cigarette lighter, primarily of the disposable type in prevalent use today, a safety device comprising a barrier to restrict the motion of the thumb lever that operates the gas valve of the lighter, which barrier is carried and supported by a spring-biased member extending from a band that is adapted to at least partially surround and slidably engage the body of the lighter, wherein the sliding motion of the band on the lighter selectively causes engagement or disengagement of the thumb lever barrier, and wherein the sliding motion of the band on the lighter may be selectively either prevented or allowed by selectively engaging or disengaging a spring-biased laterally-extending member comprising a pin or a tab adapted to fit into a pre-existing hole or opening in the lighter's structure. Thus, to ignite the lighter, the pin or tab on the spring-loaded member must first be held disengaged from its mating hole or opening while the band is moved axially relative to the generally cylindrically-shaped lighter, thereby also moving the barrier from engagement with the thumb lever.

the barrier for engaging the thumb lever may be an extension of the supporting spring arm that makes physical contact with the thumb lever beneath a peripheral extension common to many such thumb levers, as is exhibited in the best mode; the barrier may alternatively be such an extension making physical contact with the thumb lever by penetrating into a specially-provided slot or opening in the thumb lever. As an alternative to such physical contact, the barrier could also be a shield that substantially surrounds the exposed edge of the thumb lever, thereby making difficult or impossible the depressing of the thumb lever by a finger, by a thumb, or by contact by any article that is relatively large in comparison with the size of the thumb lever. Such a shield would not necessarily make physical contact with the thumb lever, but, for the purposes of this patent, this shielding is embraced by the term 'engagement'. In this embodiment, the end of a rod could depress the thumb lever and thereby activate the flow of fuel to the flame support, but, for the lighters that are commonly in use as disposable lighters, such a rod would effectively inhibit the easy manipulation of the friction wheel that engages the flint to ignite the gas; thus the safety of the lighter is improved.

In the preferred mode, the band comprises a sleeve that completely encases the body of the lighter, partially enveloping the bottom thereof as well. The lighter is inserted through the open top of the sleeve by temporarily springing apart the operating members of the band, i.e, the barrier and the lateral projection, just as is done to insert the lighter into the less extensive band of other embodiments. To slide the sleeve relative to the lighter and thereby move the barrier from engagement with the thumb lever, the pin or tab must be held in a disengaged position and the lighter pushed by applying pressure to its bottom through the bottom opening, which is substantially the only access to the body of the lighter. In this mode, which has already seen limited testing with children, it is extremely unlikely that children without instruction will be able to release the barrier to light the lighter.

DETAILED DESCRIPTION OF THE INVENTION

This invention will best be understood by referring to the attached drawings, wherein the same part is identified throughout by the same reference number.

Figures 6, 7, 8, 9, 10, 11:
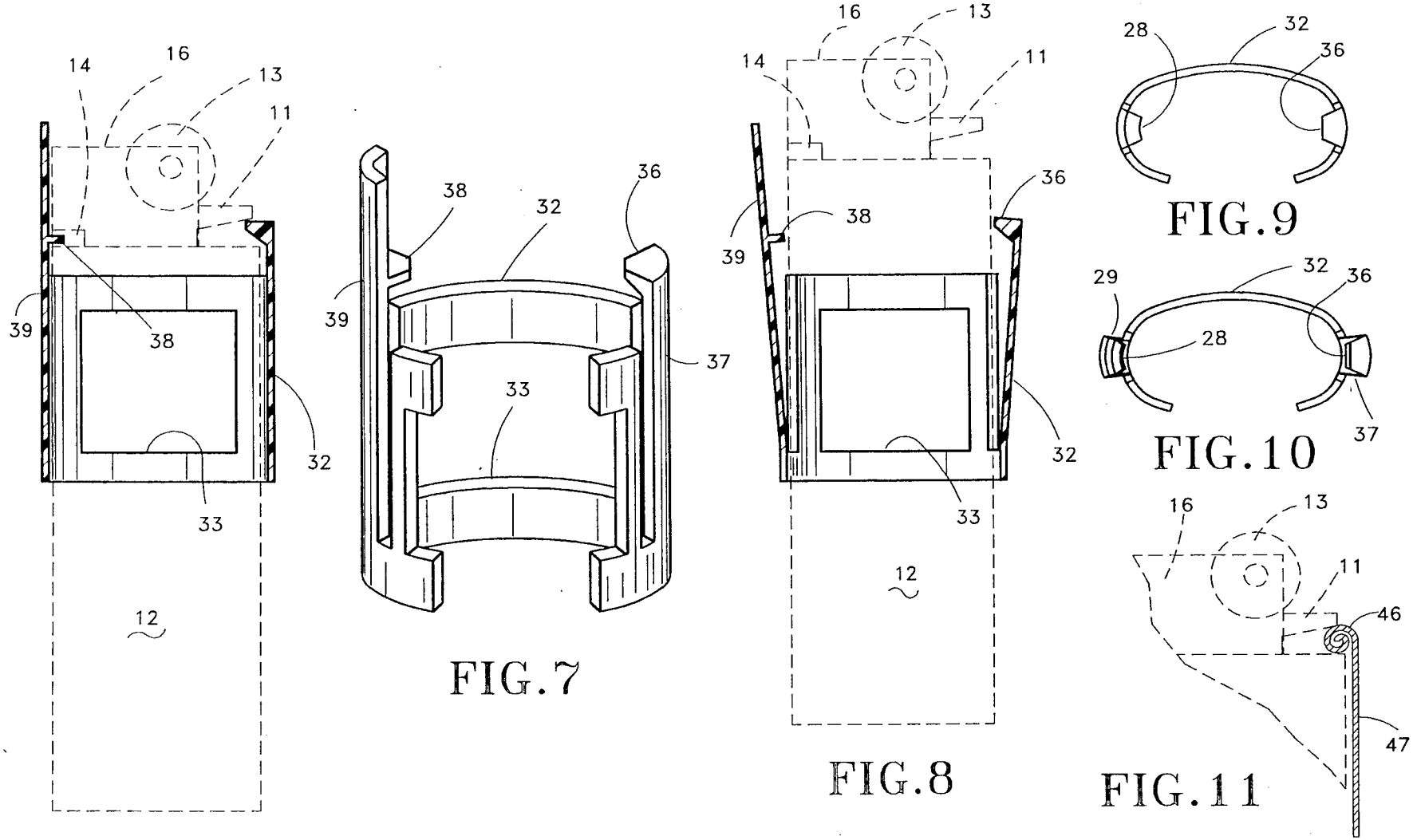
FIG. 6 is a cross sectional view through the center of an alternate embodiment of the invention installed on a disposable cigarette lighter, shown in phantom, wherein the lighter is rendered inoperable.
FIG. 7 is a perspective view of the alternate embodiment of the invention showing that it need not completely encircle the lighter.
FIG. 8 is a cross sectional view through the center of the alternate embodiment of the invention installed on a disposable cigarette lighter, shown in phantom, wherein the invention is in position to allow operation of the lighter.
FIG. 9 is a top view of the alternate embodiment of the invention in its normal position as in FIG. 6 or FIG. 7.
FIG. 10 is a top view of the alternate embodiment the invention in its released position as in FIG. 8.
FIG. 11 is a cross-sectional view showing detail of the invention when it is made of metal.

The first and best-mode embodiment of this invention is illustrated in FIGS. 1 through 5. An alternate embodiment is illustrated in FIGS. 6 through 10. A detail that may be included is illustrated in FIG. 11 only.

The lighter 10 itself is of commonly known design and has a thumb lever 11 that is operationally connected to a gas fuel valve that, when the thumb lever is depressed, allows fuel flow to a burner tip or flame support where the fuel may be ignited, usually by means of a pyrophoric igniter comprising a 'flint' that is abraded by a friction wheel 13. Clearly, if the thumb lever 11 is restricted from being depressed, the gas fuel will not flow to the burner tip and no flame can result. The purpose of the present invention is to restrict the thumb lever during non-use of the lighter, and to selectively remove the restriction by a manipulation that children have difficulty in deciphering and accomplishing.

Figure 3:
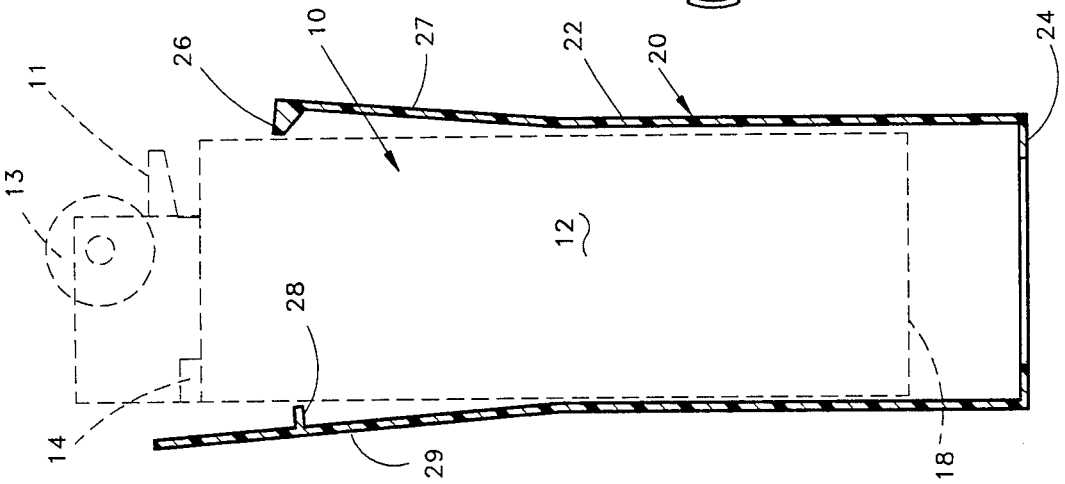
FIG. 3 is a cross sectional view through the center of the invention installed on a disposable cigarette lighter, shown in phantom, wherein the invention is in position to allow operation of the lighter.
Figure 2:
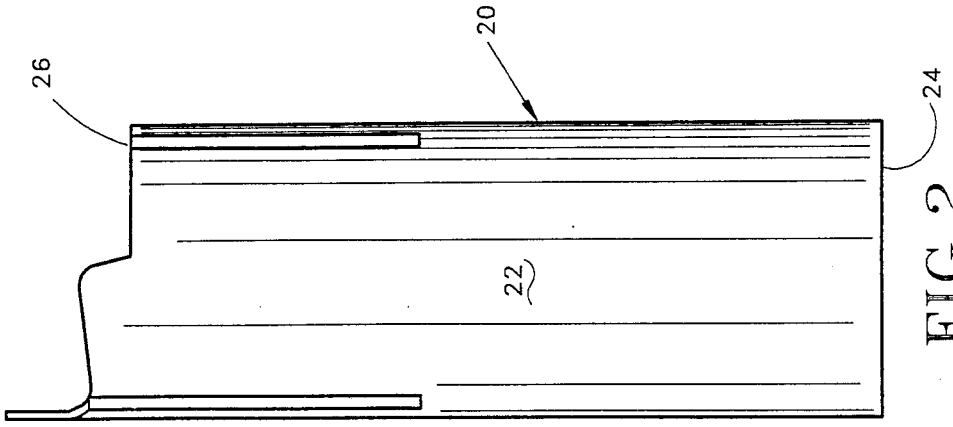
FIG. 2 is a front view of the invention standing alone, without being installed on a cigarette lighter.
Figure 1:
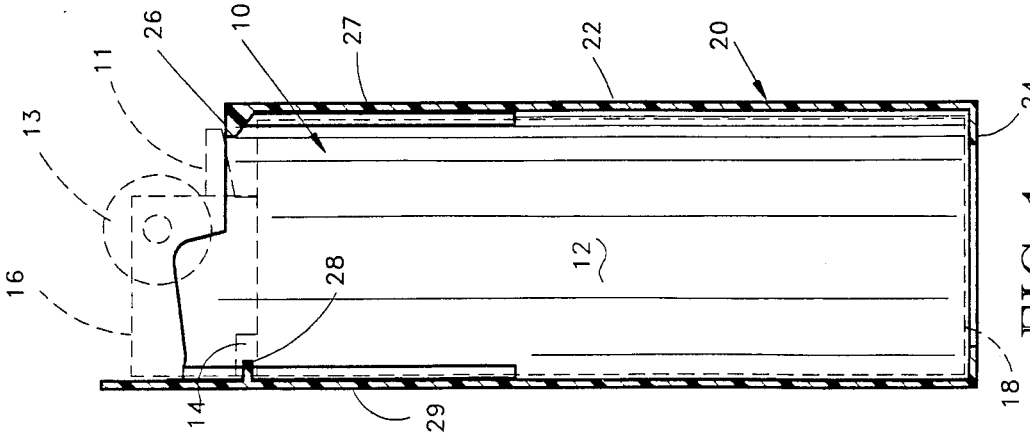
FIG. 1 is a cross-sectional view through the center of the invention installed on a disposable cigarette lighter, shown in phantom, wherein the lighter is rendered inoperable.

FIG. 1 is a cross-sectional view through the center of the invention 20 installed on a disposable cigarette lighter 10, shown in phantom, wherein the lighter is rendered inoperable by the invention. FIG. 3 is a similar cross-sectional view wherein the lighter has been made operable by sliding it upward in the invention to remove the restricting means from the thumb lever 11. In this embodiment, the invention comprises a sleeve or jacket 22 that is adapted to be slipped over the body 12 of a butane gas fueled cigarette lighter 10; the invention also comprises: a restricting means 26 adapted to engage and thereby restrict the thumb lever 11 of the lighter from being depressed when the jacket is in its safety position, which restricting means is connected to the jacket by a first biasing means 27; and a locking means 28 adapted to engage an opening 14 in the lighter thereby to lock the jacket into its safety position, which locking means is connected to the body of the jacket by a second biasing means 29. First and second biasing means may be of unitary construction with the jacket, as shown in the figures as the preferred mode, or it may be an attachment to the jacket. For purposes of releasing the locking means, the biasing means extends above the flame shield 16 that helps to protect the lighter's flame from being blown out by the wind.

In this embodiment the jacket completely covers the body of the lighter. It is essential in this embodiment that the bottom 24 of the jacket be open to expose the bottom 18 of the lighter for pushing the lighter up out of the jacket from a first position (also called the safety position), shown in FIG. 1, in which position the lighter is inoperable to a second position (also called a released position), shown in FIG. 3, in which position the lighter is usable. The open bottom is more clearly seen in the top views, FIG. 4 and FIG. 5, the former showing the normal or locked position, wherein the first and second biasing means are relaxed or unstressed, and the latter showing the unlocked position, wherein the first and second biasing means are under stress and are kept under stress by contact with the body of the lighter as shown in FIG. 3.

Operating of the safety adaptor of this inventions is as follows:

a. Using slight manual pressure, spread the two biasing means 27 29 to insert the lighter into the adaptor, pushing it all the way to the bottom and releasing the biasing means to allow engagement of the locking means 28 and the restricting means 26 with the lighter, as shown in FIG. 1. The lighter is now inoperable.

b. Using slight manual pressure, move the second biasing means 29 laterally to disengage the locking means 28 from the slot or opening 14; while holding the locking means in this released position, push the lighter up from the bottom 18, through the bottom opening 24 in the jacket 22, thereby moving the thumb lever 11 away from the restricting means 26. The lighter is now operable.

c. Grasping the jacket 22, push the top of the lighter back into the jacket until locking means 28 engages opening 14, at which time restricting means 26 will be engaged with thumb lever 11 as shown in FIG. 1. The lighter is again inoperable.

In the present design, the invention is adapted to fit commercially available lighters. It is common for these lighters to have a flame adjusting lever or dial accessible through a slot or other opening 14 near the burner tip. Thus, in the present invention, the locking means 28 is adapted to fit into this slot or other opening, although the opening is not intended for this purpose. Were one designing a lighter specifically for an adaptor of this sort, alternative locking means might be employed by providing an opening specifically intended for receiving a projection from a biased locking means such as 28.

In the alternate embodiment of FIGS. 6 through 10, the invention is also adapted to fit commercially available lighters. Rather than fitting the body of the lighter 10 as a sleeve completely encircling and covering it, this embodiment comprises a band 32 that at least partially encircles only a portion of the length of the body 12 of the lighter. Included in this band may be an opening 33 that either may prevent the obscuring of advertising or other indicia on the body of the lighter or may carry advertising or other indicia, serving as a frame or retainer therefor. This is a feature that could equally well be used in the earlier-described embodiment.

In this embodiment the locking means 38 prevents the band 32 from sliding either up or down on the lighter body. The restricting means 36 also aids in preventing the band 32 from sliding up and possibly off the lighter body.

First biasing means 37 and second biasing means 39 associated with this embodiment are identical in form and function to the first biasing means 27 and second biasing means 29 associated with the first embodiment.

Operation of this embodiment of the safety adaptor of this invention is as follows:

a. Using slight manual pressure, spread the two biasing means 37 39 to insert the lighter into the adaptor far enough to, upon release of the manual pressure, allow engagement of the locking means 38 and the restricting means 36 with the lighter, as shown in FIG. 1. The lighter becomes inoperable.

b. Using slight manual pressure, move the second biasing means 39 laterally to disengage the locking mans 38 from the slot or opening 14; while holding the locking means in this released position, push the lighter up, thereby moving the thumb lever 11 away from the restricting means 36. The lighter is now operable.

c. Grasping the band 32, push the top of the lighter back into the jacket until locking means 38 engages opening 14, at which time restricting means 36 will be engaged with thumb lever 11 as shown in FIG. 1. The lighter is again inoperable.

Figure 4:
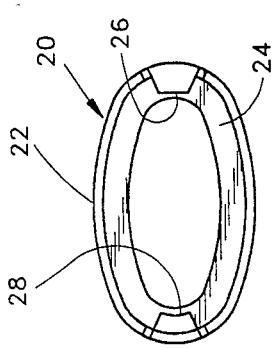
FIG. 4 is a top view of the invention in its normal position as in FIG. 1 or FIG. 2.
Figure 5:
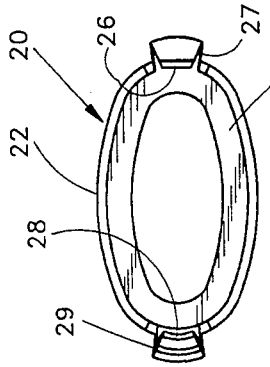
FIG. 5 is a top view of the invention in its released position as in FIG. 3.

The bottom views of the alternate embodiment presented as FIGS. 9 and 10 further accentuate the clip type nature of this embodiment as opposed to the embodiment shown in FIGS. 4 and 5. FIG. 9 shows the normal or locked position, wherein the first and second biasing means are relaxed or unstressed as in FIG. 6; FIG. 10 shows the unlocked position, wherein the first and second biasing means are under stress and are kept under stress by contact with the body of the lighter as shown in FIG. 8.

In the above embodiments, the preferred method of manufacture is by plastic injection molding, but this invention is not limited to such manufacturing techniques; the concept was initially to use formed sheet metal for the invention. Where metal is used for the second biasing means, as shown in FIG. 11, the restricting means 46 may be most simply made by coiling the free end of the biasing means 47.

Now, having presented description and specific examples of my invention by way of explanation so one skilled in this art may reproduce the product of my invention, it should be understood that the invention has greater breadth than one can delineate in a few specific examples. It is my wish and intention to include in my invention the extent of the art that may be immediately obvious from my descriptions and examples; such breadth is included in the claims attached hereto.

I claim:

1. For a gas-fueled cigarette lighter, primarily of the disposable type comprising a fuel tank and a flame support with a fuel valve therebetween that is linked in operational relationship to a thumb lever, the depressing of which thumb lever allows the flow of fuel to the flame support where it may be ignited and burned, a safety device comprising a barrier adapted to engage the thumb lever to restrict the motion of the thumb lever relative to the body of the lighter, which barrier is carried and supported by a spring-loaded finger extending from a band that is adapted to at least partially surround and slidably engage the body of the lighter, wherein the sliding motion of the band on the lighter selectively causes engagement or disengagement of the barrier with the thumb lever, and wherein the sliding motion of the band on the lighter may be selectively prevented or allowed by the selective engaging or disengaging of a spring-loaded member having a laterally extending projection, as a pin or a tab for examples, adapted to fit into a pre-existing opening, a hole or a slot for examples, in the lighter's structure, wherein, to allow depressing of the thumb lever and thereby to permit gas flow to the flame support of the lighter, the projection on the spring-loaded member must first be held disengaged from its mating opening while the band is slid axially relative to the generally cylindrically-shaped lighter, thereby also moving the barrier from engagement with the thumb lever.

2. The safety device described in claim 1 wherein said band comprises a sleeve that completely surrounds and encases the body of the lighter, partially enveloping the bottom thereof while leaving an opening exposing a portion of the bottom of the lighter, whereby to slide the sleeve relative to the lighter and thereby move said barrier from engagement with said thumb lever, the spring-loaded projection must first be held disengaged from its mating opening while the lighter is pushed by applying pressure to its bottom through the bottom opening of said sleeve.

3. The safety device described in claim 1 or claim 2 wherein said engagement between said barrier and said thumb lever comprises physical contact between them.

4. The safety device described in claim 1 or claim 2 wherein said engagement between said barrier and said thumb lever comprises the shielding of said thumb lever by said barrier to significantly reduce accessibility of the thumb lever by the fingers, thumb, or other objects.

* * * * *